US005829653A

United States Patent [19]

Kaiser

[11] Patent Number: 5,829,653

[45] Date of Patent: Nov. 3, 1998

[54] BULLET-RESISTANT BELT PACK WITH NECK STRAP ATTACHMENT

[76] Inventor: James M. Kaiser, 611 Howard St. #111, Glendale, Calif. 91206

[21] Appl. No.: 761,491

[22] Filed: Dec. 6, 1996

[51] Int. Cl.[6] ..... A45F 4/00; F41H 1/02

[52] U.S. Cl. ..... 224/577; 224/238; 224/578; 224/586; 224/587; 224/625; 224/664; 224/683; 224/911; 224/914; 2/2.5

[58] Field of Search ..... 224/911, 914, 224/576, 577, 578, 581, 586, 625, 587, 664, 683, 676, 238, 236; 2/2.5

[56] References Cited

U.S. PATENT DOCUMENTS

| | | | |
|---|---|---|---|
| 3,745,938 | 7/1973 | Hathaway et al. . | |
| 4,475,247 | 10/1984 | Lee . | |
| 4,924,527 | 5/1990 | Hintermeyer . | |
| 4,966,320 | 10/1990 | DeSantis et al. . | |
| 5,031,733 | 7/1991 | Chang . | |
| 5,170,919 | 12/1992 | DeSantis et al. . | |
| 5,294,031 | 3/1994 | Volpei et al. . | |
| 5,431,318 | 7/1995 | Garcia | 224/911 |
| 5,505,355 | 4/1996 | Williams | 224/911 |

OTHER PUBLICATIONS

Second Chance Body Armor catalog, by Second Chance Body Armor, Inc. 1996, pp. 1–27.

*Primary Examiner*—Linda J. Sholl
*Attorney, Agent, or Firm*—Graham & James LLP

[57] ABSTRACT

The present invention is directed to a belt pack for use by law enforcement officials or civilians for handgun concealment and torso protection. The belt pack includes an upper compartment and a lower compartment. The compartments are foldably connected at one end and attached by VELCRO or a similar securing method at another end. Inserts composed of KEVLAR or other bullet-resistant material are contained within interior sections of both compartments. The upper compartment further includes a metal trauma plate to protect the chest of the wearer. When opened, the belt pack reveals a handgun holster attached to the lower compartment and areas along the upper compartment for identification, such as police badges. A neck strap coupled to upper compartment allows the belt pack to serve as a bullet-resistant vest for the wearer.

20 Claims, 3 Drawing Sheets

BULLET-RESISTANT BELT PACK WITH NECK STRAP ATTACHMENT

BACKGROUND OF THE INVENTION

1. Field of the Invention

The present invention relates to a bullet-proof belt pack for housing a firearm. Specifically, when closed, the belt pack can be used to conceal a firearm. The belt pack includes a tab that can be pulled to open the pack, thus exposing a neck strap attachment. The pack functions as a puncture-resistant vest when worn using the neck strap.

2. Background

In these increasingly violent times, civilians, police officers and other law enforcement personnel often find themselves in life-threatening situations. For instance, many citizens are terrorized by the actions of would-be robbers, drug dealers, and gang members. Law enforcement officers are then called upon to apprehend these extremely violent individuals. In such situations, citizens and police officers are forced to use firearms to subdue and/or arrest the suspect. Unfortunately, firearms also fall into the hands of the unscrupulous and violent suspect who, in an attempt to evade arrest, is far too willing to exchange gunfire.

To protect themselves during potentially dangerous situations, many law enforcement officers use body armor. The most common type of body armor is the bullet-resistant vest. These vests typically comprise panels formed of a ballistic fabric material, such as KEVLAR, which is especially resistant to puncturing by projectiles including bullets, as well as from knives. The officer attaches the vest to the front part of her torso using straps that attach along the officer's back. The vest is typically worn underneath the clothing. Alternatively, the officer may wear the vest over her uniform. In either case, the vest is somewhat conspicuous.

In certain situations, however, body armor is not an available option. Off-duty officers rarely wear body armor; the need for a vest is not obvious until it is too late. Moreover, the use of a bullet-resistant vest by a private citizen is neither practical nor affordable. In addition, certain situations require discreet apprehension of a suspect. Undercover law enforcement personnel, for example, must look and behave like civilians. Indeed, the success of most undercover operations depends upon the anonymity of the officers involved. Similarly, officers involved in covert drug busts must hide or disguise their identities while investigating potential drug sales. In a typical "door-knock" situation, an officer appears to be a vagrant attempting to enter an apartment building where drugs are known to be sold. Upon entering the building, however, the officer brandishes a badge and firearm and knocks on a suspect's door. In both the undercover and door-knock scenarios, the use of cumbersome body armor is not feasible.

Civilians and undercover officers are further faced with the problem of properly concealing a firearm. Many undercover officers carry the firearm in a pocket, such as a side trousers pocket. Carrying the firearm in a trousers pocket, however, creates certain difficulties in rapidly accessing the gun. When the officer is in a seated position, the gun cannot be readily removed from the pocket. Alternatively, if the officer's free hand is engaged, it is very difficult to remove the firearm from the pocket with the opposite hand. In such situations, the officer may be powerless to use the firearm against the assailant. An additional problem caused by carrying the firearm in a trousers pocket is that the gun tends to wear the material of the pocket, frequently forming holes in the bottom of the pocket. Moreover, the trousers are not very effective in concealing the gun, and by giving away the shape of the gun the assailant can be alerted to the existence of the gun.

Accordingly, a need exists for a discreet bullet-resistant apparatus for use by undercover police officers, off-duty police officers, and civilians.

Further, a need exists for an apparatus capable of concealing a firearm used by an undercover officer or a civilian.

SUMMARY OF THE INVENTION

In accordance with the teachings of this invention, a bullet-resistant belt pack having a neck strap attachment for use as a vest is provided. The belt pack allows a wearer to conceal a firearm on her person, yet positions the firearm to make it readily accessible for emergency situations. This is provided according to the present invention by using a simulated "fanny pack". The belt pack, when closed, appears to be a conventional fanny pack often worn as a utilitarian article of fashion. The belt pack, however, includes detachable compartments that open to house a firearm. Further, each compartment includes a bullet-resistant insert. A neck strap facilitates the use of the pack as a vest.

In a preferred embodiment, the belt pack includes lower and upper compartments foldably connected to each other at one end. At an opposite end of each compartment, the lower and upper compartments are removably connected by VELCRO or other fastening means. Each compartment is lined with a bullet-resistant insert, such as KEVLAR. A bullet-resistant flap is disposed along an outer edge of the upper and lower compartments where those compartments are joined. In addition, the lining of the upper compartment may include a metal trauma plate to protect the upper torso of the wearer. A zipper pouch is disposed within the lower compartment.

The lower compartment contains a holster for housing a firearm. The upper compartment contains a badge holder. A belt strap is coupled to the lower compartment, thus permitting the pack to be worn around the waist. A neck strap is coupled to the upper compartment and is hidden from view when the belt pack is in a closed position. The strap includes a tab that can be pulled to open the belt pack.

When the tab is pulled, the VELCRO fastener is opened. The neck strap is placed around the neck, thus pulling the upper compartment over the upper torso. The firearm becomes available and the badge is immediately visible. The belt pack may then function as a bullet-proof vest.

A more complete understanding of the bullet-resistant belt pack with neck strap attachment will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The present invention provides a safety-enhancing apparatus for use by law enforcement personnel and civilians which enables a person to conceal a firearm for use during an emergency situation, while also being convertible to a bullet-resistant vest.

Figure 1:
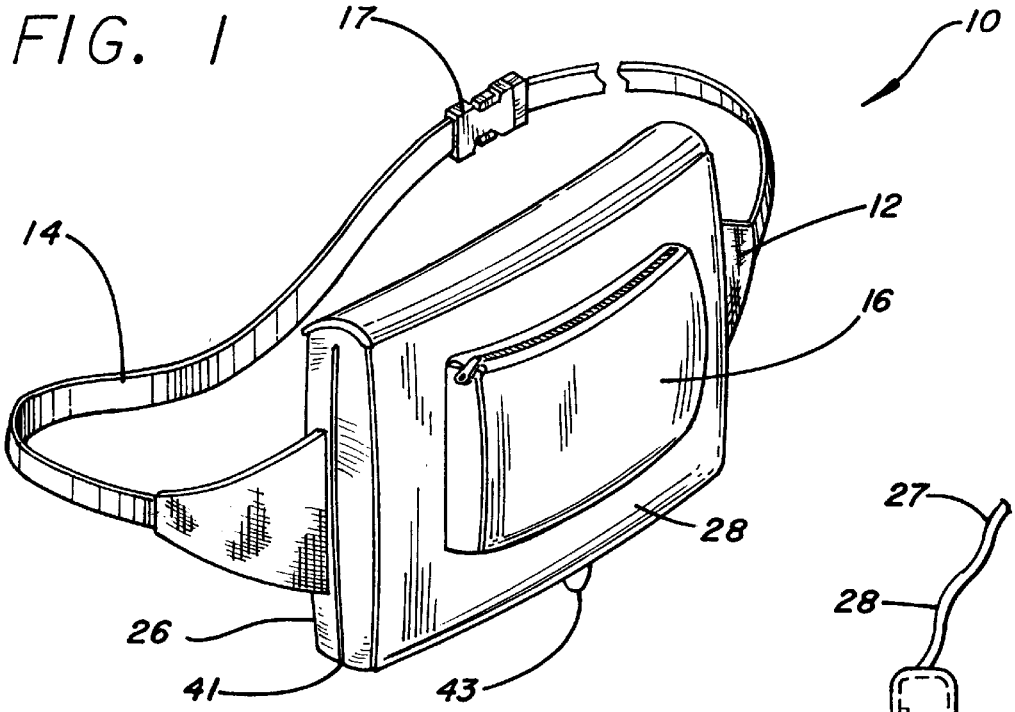
FIG. 1 is a perspective view of the bullet-resistant belt pack of the present invention, illustrating the lower and upper compartments in a closed position.

Referring first to FIG. 1, a belt pack 10 of the present invention is illustrated. The belt pack 10 includes an upper compartment 28 and a lower compartment 26 (see FIG. 2) foldably coupled to the upper compartment 28, each of which include an internal space for carrying a panel of ballistic fabric material 56, 58 (see FIG. 4). Materials usable in accordance with the present invention include the materials sold under the trademark KEVLAR ("KEVLAR") by E.I. Du Pont De Nemours & Co., which material consists of aramid fibers. Other puncture-resistant material may be used, however. The upper and lower compartments 28, 26 are generally rectangular in shape, although other shapes may be used to better approximate the shape and size of a standard belt pack. Preferably, each compartment 28, 26 has a width of approximately 12 inches and a height of approximately 8 inches. In addition, the upper compartment contains a zippered pouch 16 formed along an outer edge thereof. The pouch 16 may be used by a wearer to carry small items, such as keys, currency, and identification. The pouch 16 is also provided to simulate the look of a typical belt pack, as worn by the general public.

The upper and lower compartments 26 and 28 may be formed of a lightweight polyester material or other comfortable material. This material would be comfortable to the wearer, easy to clean, resistant to tearing, and could be manufactured in a variety of sizes and colors. A wearer may periodically remove the panels 56, 58 to be cleaned.

The belt pack is designed to be worn around the waist of a wearer in an initially closed position as shown in FIG. 1. The belt pack 10 is secured to the wearer by use of an adjustable belt 14 having two portions. The belt 14 is attached to an area proximate the center of the lower compartment 26 by connecting flaps 12. The belt portions are coupled by a connecting device 17 at respective ends opposite the upper and lower compartments 28, 26. The connection device is a male/female connector with a snap-in portion with flexible extensions and an aperture portion. The flexible extensions may be flexed inward for insertion in the aperture. Once inserted, the extensions snap back and secure the two portions of the device 17. Adjustment of the lengths of the belt 14 can be made by pulling or loosening one portion of the belt 14 that loops through an adjustment hook (not shown). The belt 14 has a height of approximately of 4 inches and tapers to a height of approximately 1.5 inches proximate the respective connection sections.

Figure 2:
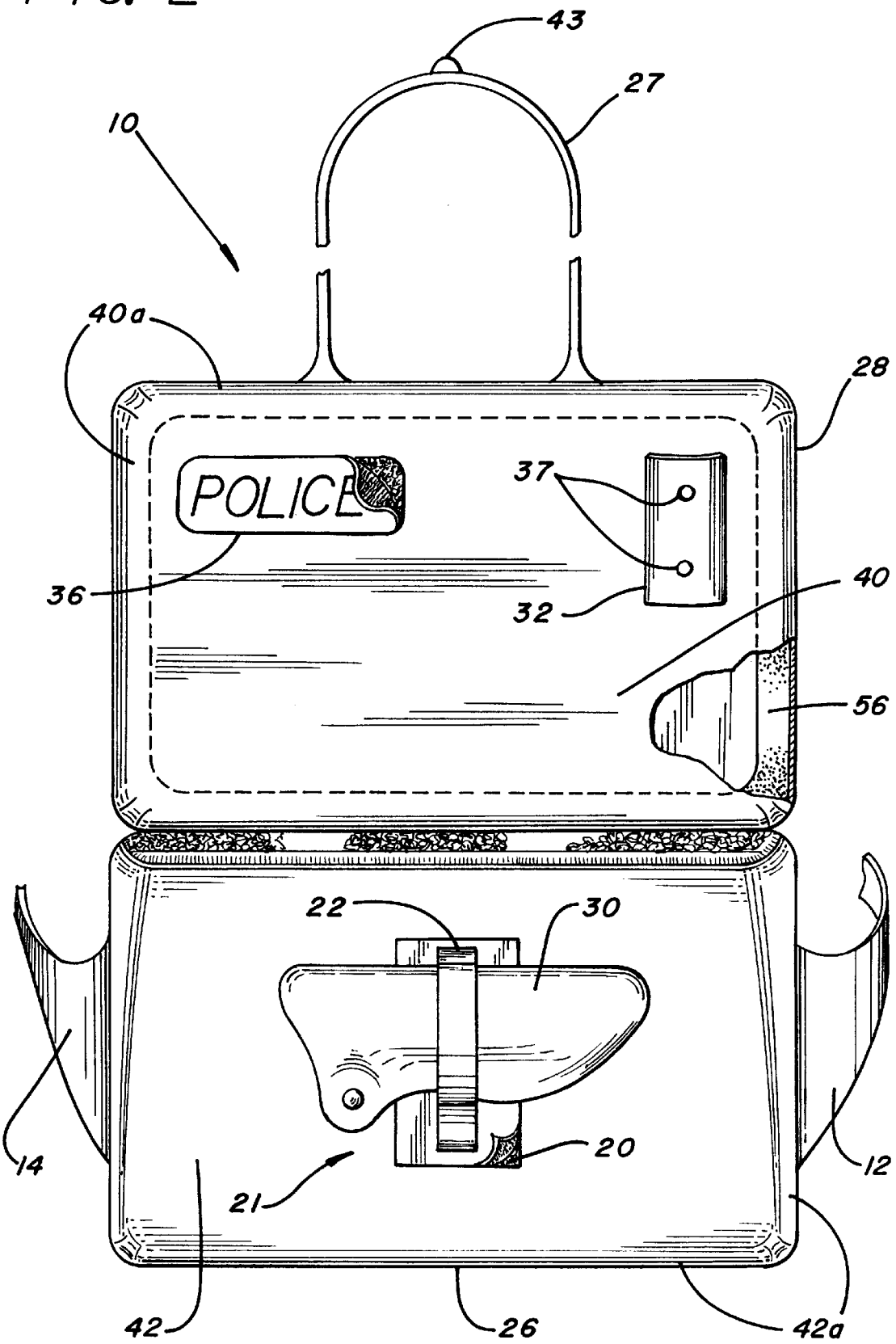
FIG. 2 is a front view of the bullet-resistant belt pack, illustrating the lower and upper compartments, in an open position.

Along inner edges, 40*a* and 42*a*, of inner surfaces, 40 and 42, of the upper compartment 28 and lower compartment 26, respectively, a fastener 41 of is provided, as shown in FIG. 2. Fasteners usable in accordance with the present invention include the fasteners sold under the trademark VELCRO ("VELCRO") by Velcro USA, Inc., which fasteners are hook and loop type fasteners. In a closed position (see FIG. 1), the loop and hook connections of the VELCRO closure 41 are coupled. When the upper compartment 28 is tugged or pulled, the VELCRO connections release to permit opening of the belt pack 10 to reveal the lower compartment 26. FIG. 2 shows the belt pack in this open position.

As shown, the inner surface 42 of the lower compartment 26 conceals a firearm 31, the barrel of which is contained within a standard holster 30. The holster is held in place by a holder 21 having an elastic strap 22 that runs along its length. The holder is coupled to a VELCRO patch 20 formed on the lower compartment 26. The VELCRO patch 20 is formed into the fabric of the lower compartment 26 and includes VELCRO connections formed thereon. The holster 30 is further held by a VELCRO connection (not shown) on both sides of the holster 30. The use of the VELCRO connection on the holster 30 and the elastic strap 22 permits the use of the holster 30 in both a right-handed position (as shown) and a left-handed position. The holster 30 prevents the firearm 31 from moving around unnecessarily within the compartment 26 due to normal movement of the wearer. The holster 30 is held in place tightly enough so as to prevent movement of the holster 30 when the firearm 31 is removed quickly. With the compartment 26 in the closed position, the shape of the firearm 31 would be generally obscured.

The inner surface 40 of the upper compartment contains a VELCRO area for receiving a VELCRO-backed identifying patch 36 or similar item. The patch 36 may be used to identify various law enforcement organizations, such as a local police agency, a county sheriff agency, or a private security organization, for instance. The VELCRO area may also be left uncovered. The inner surface 40 further contains a rectangular area 32 sewn into the fabric for receiving a law enforcement badge. The area 32 includes a pair of badge receptacles 37 that accept the dual prongs of a standard police badge. The area 32 may also include other receptacles for receiving other forms of official law enforcement identification.

An adjustable neck strap 27 is coupled to an edge of the upper compartment 28. The neck strap 27 is formed of nylon or similar material and is designed to be worn comfortably around the neck when the belt pack 10 is in an open position. The neck strap 27 is connected at two points 35, 37 of the upper compartment 28. When extended, the neck strap 27 forms a rectangular opening sufficiently large enough to be placed around a neck of the wearer. The strap 27 further includes a tab 43 that extends from an edge of the strap 27. When the belt pack 10 is in a closed position, the strap 27 is obscured by the upper compartment 28. The tab 43, however, is exposed. In an emergency situation, the tab 43 may be tugged or pulled to exert an outward pressure on the upper compartment 38, thus forcing it open. While the tab 43 is still being held by the wearer, the strap 27 may easily be placed over the neck of the wearer.

Figure 3:
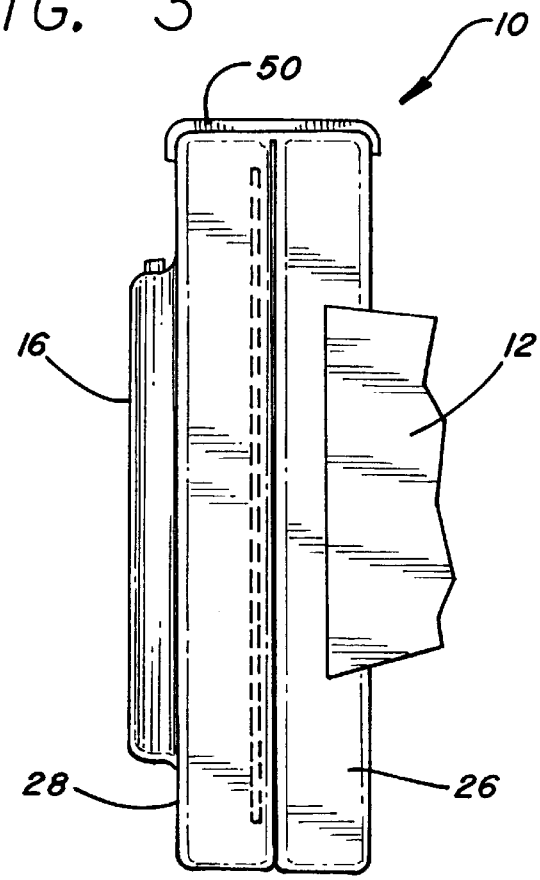
FIG. 3 is a side view of the bullet-resistant belt pack, illustrating the lower and upper compartments in a closed position.
Figure 4:
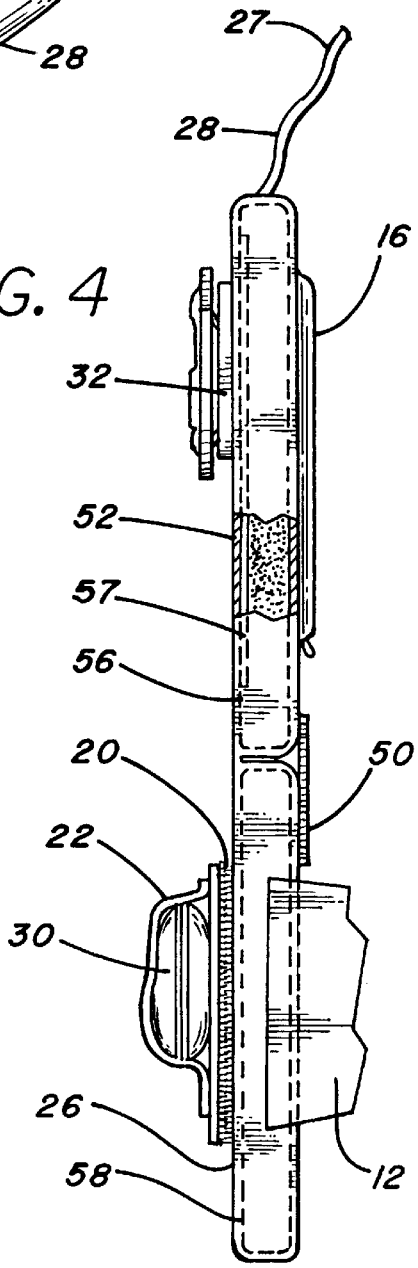
FIG. 4 is a side view of the bullet-resistant belt pack, illustrating the lower and upper compartments in an open position.

FIGS. 3 and 4 illustrate a side view of the belt pack 10 in open and closed positions. As these figures show, to provide security to the wearer, the belt pack 10 includes a KEVLAR panel 56 placed in an interior space of the upper compartment 28, a KEVLAR panel 58 placed in an interior space of the lower compartment 26, a KEVLAR flap 50 coupled to the upper and lower compartments around a middle portion, and a metal trauma plate 52 formed in the interior space of the upper compartment 28. The KEVLAR flap 50 covers the area between the upper KEVLAR panel 56 and the lower KEVLAR panel 58 that might be exposed when the belt pack 10 is placed in an open position. The flap 50 protects an area of the wearer's midsection. The metal trauma plate 52 may be manufactured of a high strength material, such as steel. The trauma plate 52 would enhance the protective capability of the belt pack 10 to the wearer, and additionally guard against possible injury from external projectiles. The interior of the upper compartment 28 would have a trauma plate pocket 57 which seals at a top portion with VELCRO or other such fastening devices. The wearer could simply slide the trauma plate 52 into the pocket 57 prior to inserting the ballistic panel 56 into the upper compartment 28.

Figure 5:
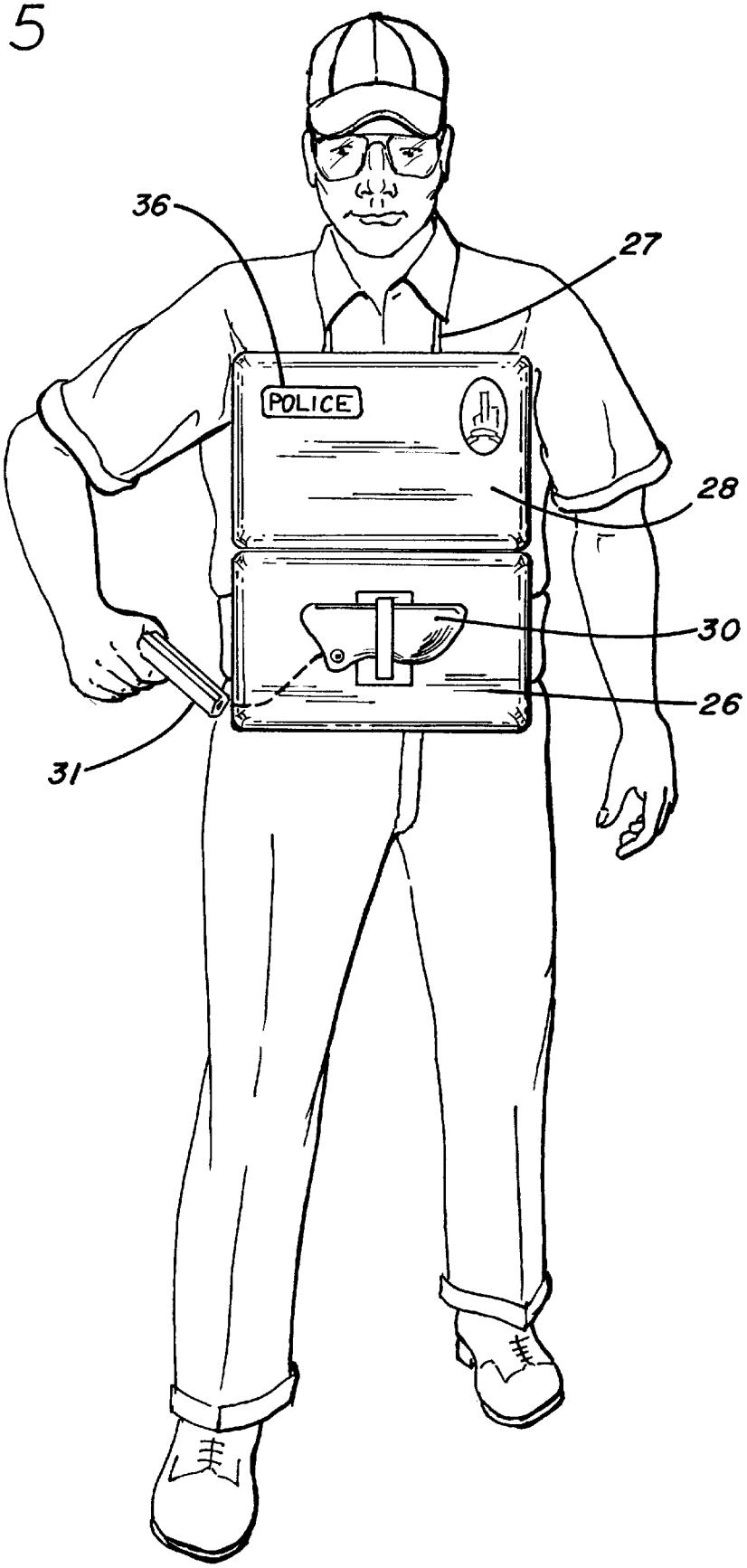
FIG. 5 is a perspective view of the bullet-resistant belt pack as worn by a typical law enforcement officer.

In normal use, the belt pack 10 would be worn around the waist of the wearer, as shown in FIG. 5. The wearer would place the firearm 31 in the holster 30. During an emergency situation in which the wearer requires access to the gun or seeks the bullet-resistant protection of the panels 56, 58, the wearer grasps the tab 43 connected to the neck strap 27. An upward pull on the tab causes the strap 27 to unseal the upper and lower compartments 28, 26. The wearer pulls the neck strap 27 over his head and places it around his neck. The wearer can then rapidly remove the firearm 31, and put it to effective use against the assailant.

Having thus described a preferred embodiment of bullet-resistant belt pack, it should be apparent to those skilled in the art that certain advantages of the within system have been achieved. It should also be appreciated that various modifications, adaptations, and alternative embodiments thereof may be made within the scope and spirit of the present invention. For example, KEVLAR panels have been illustrated, but it should be apparent that the inventive concepts described above would be equally applicable to other bullet-resistant materials that are readily available on the market. In addition, FIG. 2 illustrates a holster disposed along an inner edge of the lower compartment 26, but it should be apparent that the holster may be easily situated along the upper compartment 28. The invention is further defined by the following claims.

What is claimed is:

1. A belt pack comprising:

a lower compartment having a first puncture-resistant insert disposed in an interior space thereof;

an upper compartment having a second puncture-resistant insert disposed in an interior space thereof, the upper pack portion being coupled to the lower compartment at a first end of the lower compartment;

means for removably coupling the lower compartment to the upper compartment at a second end of the lower compartment;

a belt strap coupled to the lower compartment; and a neck strap coupled to the upper compartment;

wherein the neck strap is hidden from view when the pack is in a closed position.

2. The belt pack, as recited in claim 1, further comprising storing means for storing a firearm between the upper compartment and the lower compartment.

3. The belt pack, as recited in claim 2, wherein the storing means further comprises:

a strap coupled to a portion of an inner edge of the lower compartment; and a holster disposed between the strap and the inner edge of the lower compartment.

4. The belt pack, as recited in claim 2, wherein the storing means further comprises:

a strap coupled to a portion of an inner edge of the upper compartment; and a holster disposed between the strap and the inner edge of the lower compartment.

5. The belt pack, as recited in claim 1, wherein the first and second puncture-resistant inserts are comprised of aramid fibers.

6. The belt pack, as recited in claim 5, further comprising a trauma plate disposed in the upper compartment adjacent the second insert, said trauma plate comprising at least one of aramid fibers and metal.

7. The belt pack, as recited in claim 6, further comprising a tab coupled to the neck strap;

wherein the belt pack opens when the tab is pulled away from the belt pack.

8. The belt pack, as recited in claim 7, further comprising a flap coupled to the lower compartment and the upper compartment, said flap comprising aramid fibers.

9. The belt pack, as recited in claim 8, wherein the means for removably coupling the lower compartment to the upper compartment further comprises:

a first fastening strip disposed along an inner edge of the lower compartment; and a second fastening strip disposed along an inner edge of the upper compartments, wherein said first fastening strip engages said second fastening strip when the belt pack is in a closed position.

10. The belt pack, as recited in claim 9, further comprising a pouch disposed along an outer edge of the upper compartment.

11. A belt pack comprising:

an upper compartment having a puncture-resistant insert disposed in an interior space thereof;

a lower compartment foldably coupled to the upper compartment at a first end;

a belt strap coupled to said lower compartment;

storage means for storing a handgun between the upper compartment and the lower compartment, whereby said storage means is concealed when said upper compartment is folded over said lower compartment, and said storage means is exposed when said belt pack is unfolded; and a neck strap coupled to the upper compartment, said neck strap being hidden from view when said upper compartment is folded over said lower compartment.

12. The belt pack, as recited in claim 11, wherein the storage means further comprises:

a strap coupled to an inner edge of the lower compartment; and a holster disposed between the strap and the inner edge of the lower compartment.

13. The belt pack, as recited in claim 11, further comprising a metal trauma plate disposed in an interior portion of the upper compartment.

14. The belt pack, as recited in claim 13, further comprising a belt coupled to the lower compartment.

15. The belt pack, as recited in claim 11, wherein the upper and lower compartments are removably coupled at a second end.

16. The belt pack of claim 11 wherein said upper compartment and said lower compartment are in communication to define a common space.

17. A belt pack comprising:

an upper portion having an upper compartment;

a lower portion foldably coupled to the upper portion and having a lower compartment;

a neck strap coupled to the upper portion;

a belt strap coupled to the lower compartment;

a puncture-resistant insert disposed in an interior space of one of said upper and lower compartments; and a storage means for storing a handgun between said upper portion and said lower portion, whereby said storage means is concealed when said upper portion is folded over said lower portion, and said storage means is exposed when said belt pack is unfolded, wherein the neck strap is hidden from view when said upper portion is folded over said lower portion.

18. The belt pack of claim 17 wherein said upper compartment further comprises:

an opening located on said upper portion, said opening providing access to an interior space of said upper compartment.

19. The belt pack of claim 18 wherein said lower compartment further comprises:

an opening located on said lower portion, said opening providing access to an interior space of said lower compartment;

wherein said upper compartment and said lower compartment are in communication to define a common space.

20. The belt pack of claim 19 wherein said puncture-resistant insert is further disposed in said common space; and wherein a middle portion of said puncture-resistant insert is comprised of aramid fabric, such that said puncture-resistant insert folds about said middle portion in unison with said upper portion and said lower portion.

* * * * *